United States Patent [19]

MacKay et al.

[11] Patent Number: 5,061,080

[45] Date of Patent: Oct. 29, 1991

[54] ROTARY AGITATOR

[75] Inventors: Donald J. MacKay, Media; Douglas H. Eden, Wallingford; R. Lee Roberts, Boothwyn, all of Pa.

[73] Assignee: Roberts Filter Manufacturing Company, Darby, Pa.

[21] Appl. No.: 616,557

[22] Filed: Nov. 21, 1990

[51] Int. Cl.[5] ..... B01F 5/10; B01F 7/16

[52] U.S. Cl. ..... 366/169; 210/221.2; 210/272; 239/254

[58] Field of Search ..... 366/150, 154, 155, 168, 366/169, 279, 280, 342, 343; 210/221.2, 272; 239/259

[56] References Cited

U.S. PATENT DOCUMENTS

| | | | |
|---|---|---|---|
| 832,252 | 10/1906 | Godbe | 366/169 |
| 2,592,904 | 4/1952 | Jackson | 366/169 |
| 3,288,297 | 11/1966 | Stuart | 210/272 |
| 3,675,850 | 7/1972 | Ebert | 239/97 |

*Primary Examiner*—Robert W. Jenkins

*Attorney, Agent, or Firm*—Caesar, Rivise, Bernstein, Cohen & Pokotilow

[57] ABSTRACT

A rotary agitator for use in filter systems has a horizontal arm formed of a single, elongate, hollow tubular section. An opening through the peripheral wall of the tubular section at substantially the midpoint thereof communicates with the hollow interior of the tubular section. An external rotor section of a central bearing assembly is secured directly to the hollow tubular section in a region overlying the opening through the peripheral wall of the tubular section. The external rotor section has a passageway therethrough communicating with the opening through the peripheral wall of the tubular section. The central bearing assembly further includes an elongate stator positioned interiorly of the external rotor section. The passage through the elongate stator is aligned with and in communication with the opening through the peripheral wall of the tubular section.

5 Claims, 3 Drawing Sheets

ROTARY AGITATOR

FIELD OF INVENTION

This invention relates generally to a rotary agitator, and more specifically to a rotary agitator for a water and/or wastewater filter system.

BACKGROUND ART

It is common practice in water and/or wastewater filter systems to employ a rotary agitator or sweep adjacent the upper surface of a particulate filter bed, to assist in the cleaning of the filter bed during a backwashing operation. Prior art agitators known to applicant include a rotary arm disposed in a horizontal plane and being connected to a central bearing assembly through a separate coupling member independent of the bearing assembly.

In one prior art device the coupling member is a T-shaped coupler having a pair of axially aligned passages for receiving separate pipe sections that form the arm of the agitator, and a third passage substantially perpendicular to the axially aligned passages for receiving a hollow, tubular member constituting an internal rotor of the central bearing assembly. This prior art arrangement requires the use of an excessive number of parts, and is relatively expensive to fabricate, particularly if one desires to construct the principal components of the agitator, e.g., the arm, the coupler and the bearing assembly, out of stainless steel components. In particular, this prior art arrangement requires the use of two pipe sections to form the arm, a separate coupler to permit the two pipe sections to be connected to the bearing assembly, and a separate bearing assembly interconnected to the coupler. Moreover, the machining operations required to provide the necessary threaded sections for connecting the components of the agitator together undesirably increase manufacturing costs.

In another prior art construction a single, elongate stainless steel pipe section is employed to form the arm of the agitator. In this construction a central, substantially circular opening is machined through the peripheral wall of the pipe, at the midpoint thereof, to communicate with the internal passage extending axially through the pipe section. A stainless steel tubular coupling is welded, about its external surface, to the elongate pipe section in surrounding relationship to the machined opening through the peripheral wall of said pipe section, and this stainless steel coupling receives a descending plastic pipe nipple forming part of the internal rotor of a plastic center bearing assembly.

Securing the internal plastic pipe nipple of the center bearing assembly to the tubular coupling provides a restricted throat, which can become the primary limiting orifice for the flow of fluid through the agitator. Thus it is desirable to enlarge the throat dimension, beyond that which has been achievable in prior art constructions employing a tubular connector secured to a single, elongate pipe section forming the arm or the agitator.

OBJECTS OF THE INVENTION

It is an object of this invention to provide a rotary agitator which is simple in design and economical to construct.

It is a further object of this invention to provide a rotary agitator which is formed from a minimum number of parts.

It is a further object of this invention to provide a rotary agitator which requires a minimum of machining operations.

It is a further object of this invention to provide a rotary agitator which can be constructed from stainless steel components in an economical manner.

It is a further object of this invention to provide a rotary agitator wherein the throat at the lower end of a central bearing assembly is not unduly restrictive to fluid flow.

SUMMARY OF THE INVENTION

The above and other objects of this invention are achieved in a rotary agitator comprising a horizontal arm formed of a single, elongate, tubular section having a peripheral wall defining a hollow interior, and an opening through the peripheral wall of the tubular section at substantially the midpoint thereof, said opening communicating with the hollow interior of said tubular section. An external rotor section of a central bearing assembly is secured directly to the hollow tubular section in a region overlying the opening through the peripheral wall of the tubular section, said external rotor section having a passageway therethrough communicating with the opening through the peripheral wall of the tubular section. The central bearing assembly further includes an elongate stator having an passage therethrough, said stator being disposed interiorly of the external rotor section with the passage of said stator aligned and in communication with the opening through the peripheral wall of the tubular section, and bearing means for rotatably mounting the external rotor section to the stator section.

In the preferred embodiment of the invention the diameter of the opening through the peripheral wall of the hollow tubular member is equal to or greater than the diameter of the passage through the stator, and the external rotor section of the central bearing assembly includes a lower saddle member secured to the periphery of the hollow tubular section, with the passageway extending through the saddle member being elongate in the axial direction of the hollow tubular section and overlying the opening through the peripheral wall of the tubular section. This arrangement of openings increases the dimension of the throat (e.g., by eliminating undesired constrictions) beyond that which has been achieved in prior art constructions employing a single tubular member as the rotary arm.

In the most preferred embodiment of the invention the lower saddle section of the external rotor section is connected to the hollow tubular member forming the arm of the agitator by a weldment disposed at the internal surface of the saddle member and surrounding the opening through the peripheral wall of the tubular section.

Most preferably the arm and the main rotor and stator elements of the agitator are made from stainless steel.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DETAILED DESCRIPTION OF THE PREFERRED EMBODIMENT

Figure 1:
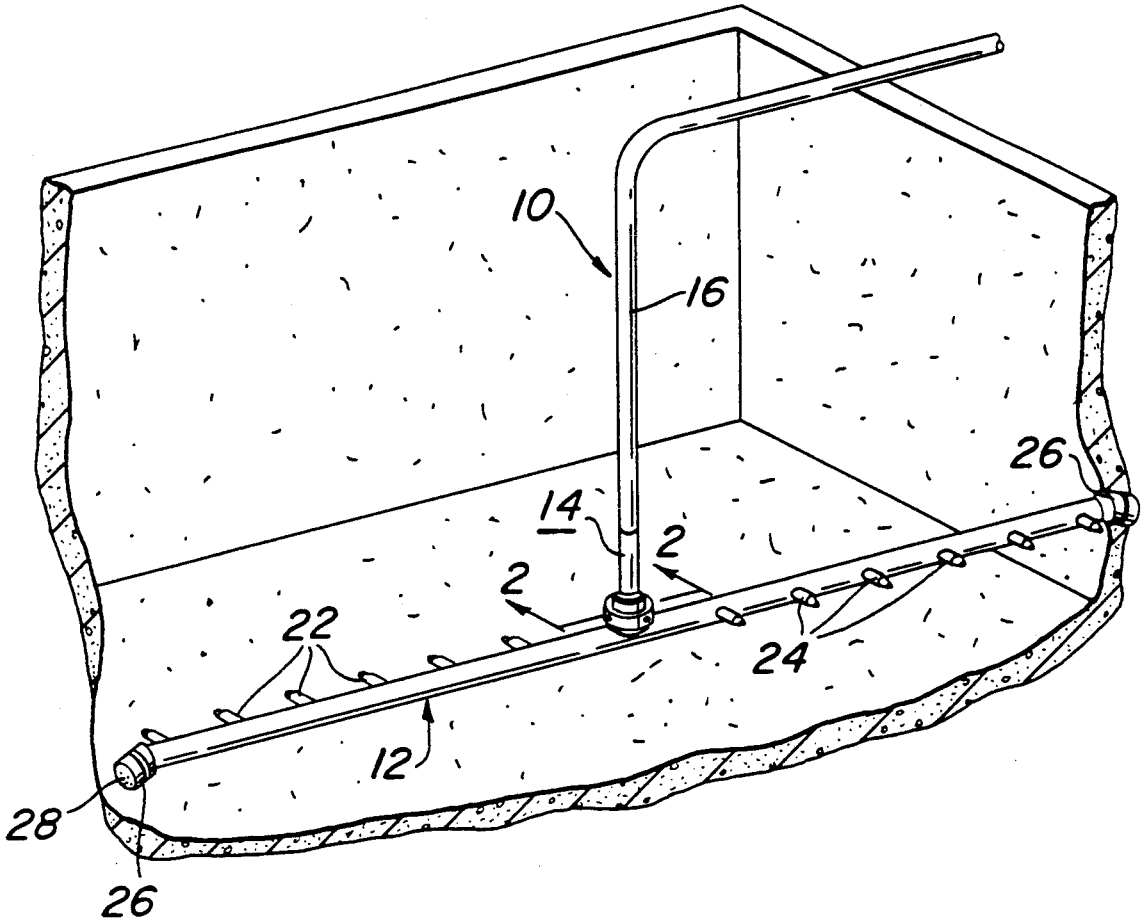
FIG. 1 is a fragmentary isometric view of a filter employing the unique rotary agitator of this invention, said filter being shown in a schematic form to illustrate the environment of use of the agitator.

Referring now in greater detail to the various figures of the drawings wherein like reference characters refer to like parts, a Rotary Agitator embodying the present invention is generally shown at 10 in FIG. 1. The Agitator 10 basically comprises an arm 12 formed of a single, elongate, hollow tubular member connected at the midpoint thereof directly to a center bearing assembly 14, without the use of a separate coupling member.

Figure 2:
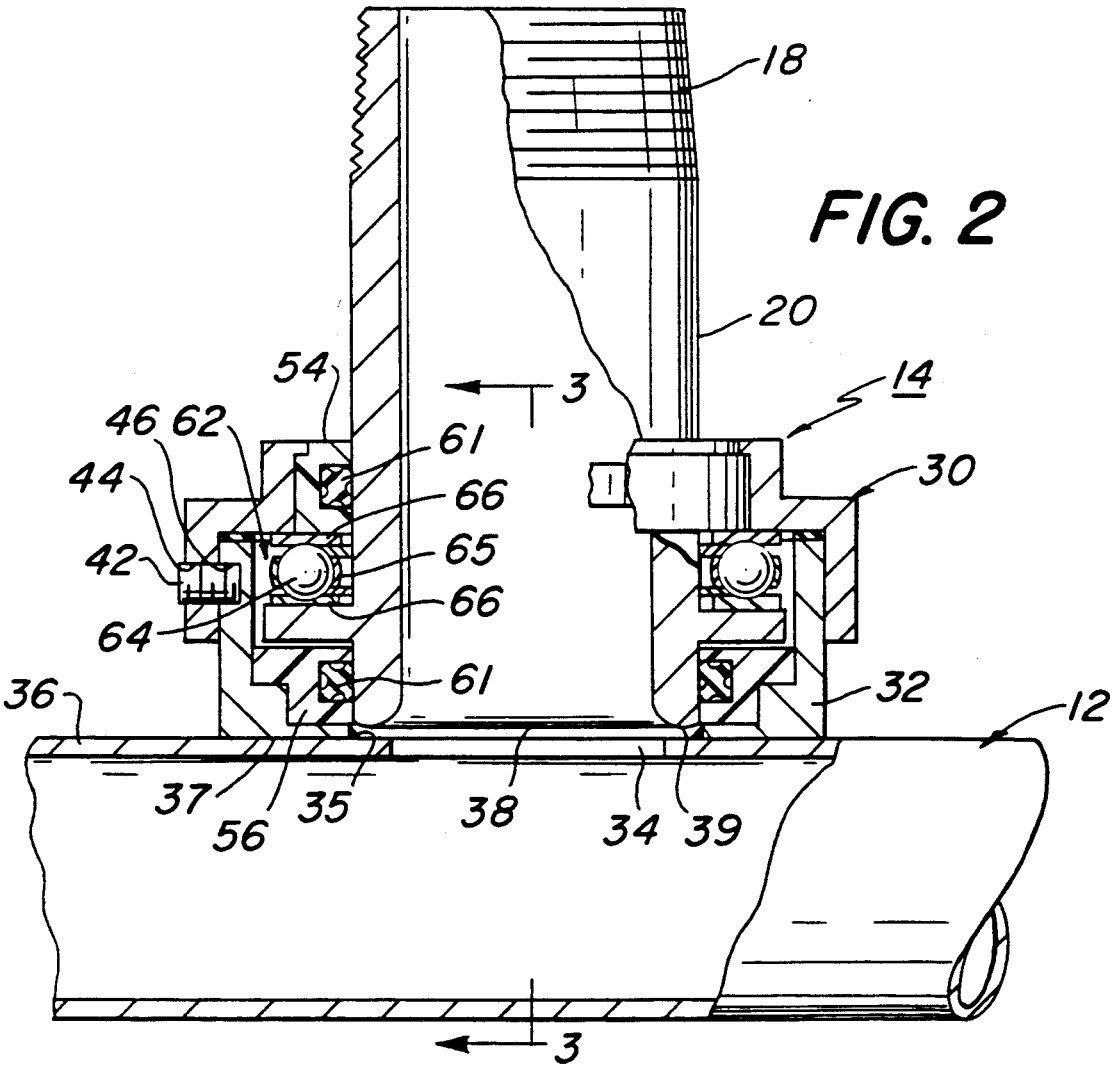
FIG. 2 is a sectional view taken along line 2—2 of FIG. 1.

Referring to FIGS. 1 and 2, a down pipe 16, in the form of a hollow conduit, is threadedly secured to the outer threaded surface at the upper end 18 of an internal, hollow stator element 20 of the bearing assembly 14. In operation, fluid (e.g., liquid) for use in washing the upper surface region of a particulate filter bed (not shown) during a backwashing operation is directed through the downpipe 16, the hollow, internal stator element 20 of the bearing assembly 14, and through a series of nozzles 22, 24 extending radially from the agitator arm 12, along the axial length thereof. As is conventional in rotary agitators the nozzles 22 and 24 extend in opposite radial directions, on each side of the central bearing assembly 14, whereby fluid directed through the nozzles provides the driving force for rotating the agitator.

The axial ends of the arm 12 are provided with nozzle members 26, for directing wash fluid to regions of the filter bed adjacent the internal walls of the filter as the agitator is being rotated. These nozzle members can be of any desired form, and do not constitute a part of the present invention. For example, on sweeps employing only one end nozzle at each axial end of the rotary arm, a disc having a threaded central passage can be welded to each end of the arm, and a single nozzle can thereafter be threaded into the central passage. On sweeps with multiple end nozzles, a short section of hollow pipe can be welded perpendicular to the arm at each axial end, thus forming a T-shaped end chamber to which a plurality of nozzles can be secured.

In the most preferred construction each of the nozzle members 26 has an end face 28 with a plurality of ports therethrough, constituting dispensing orifices for the fluid directed to the axial ends of the arm 12. The construction of each of these latter nozzle members 26 is described in detail in copending application Serial No. 616,558, filed on even date herewith in the name of R. Lee Roberts, entitled NOZZLES FOR ROTARY AGITATORS and assigned to Roberts Filter Manufacturing Company. The subject matter of this latter application is incorporated herein by reference.

Figure 3:
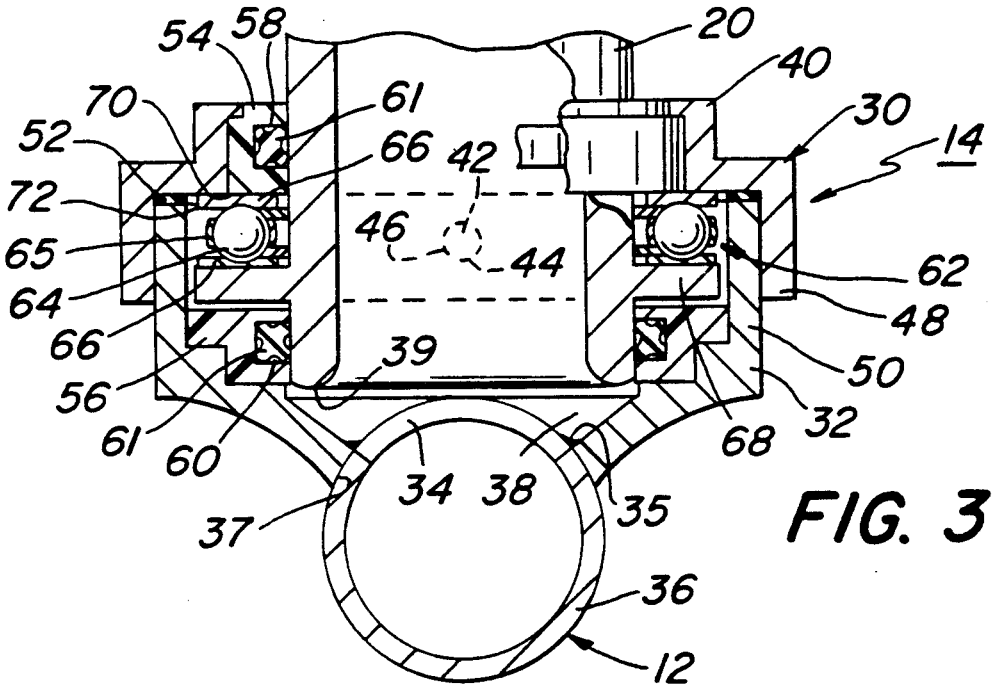
FIG. 3 is a sectional view taken along line 3—3 of FIG. 2.
Figure 4:
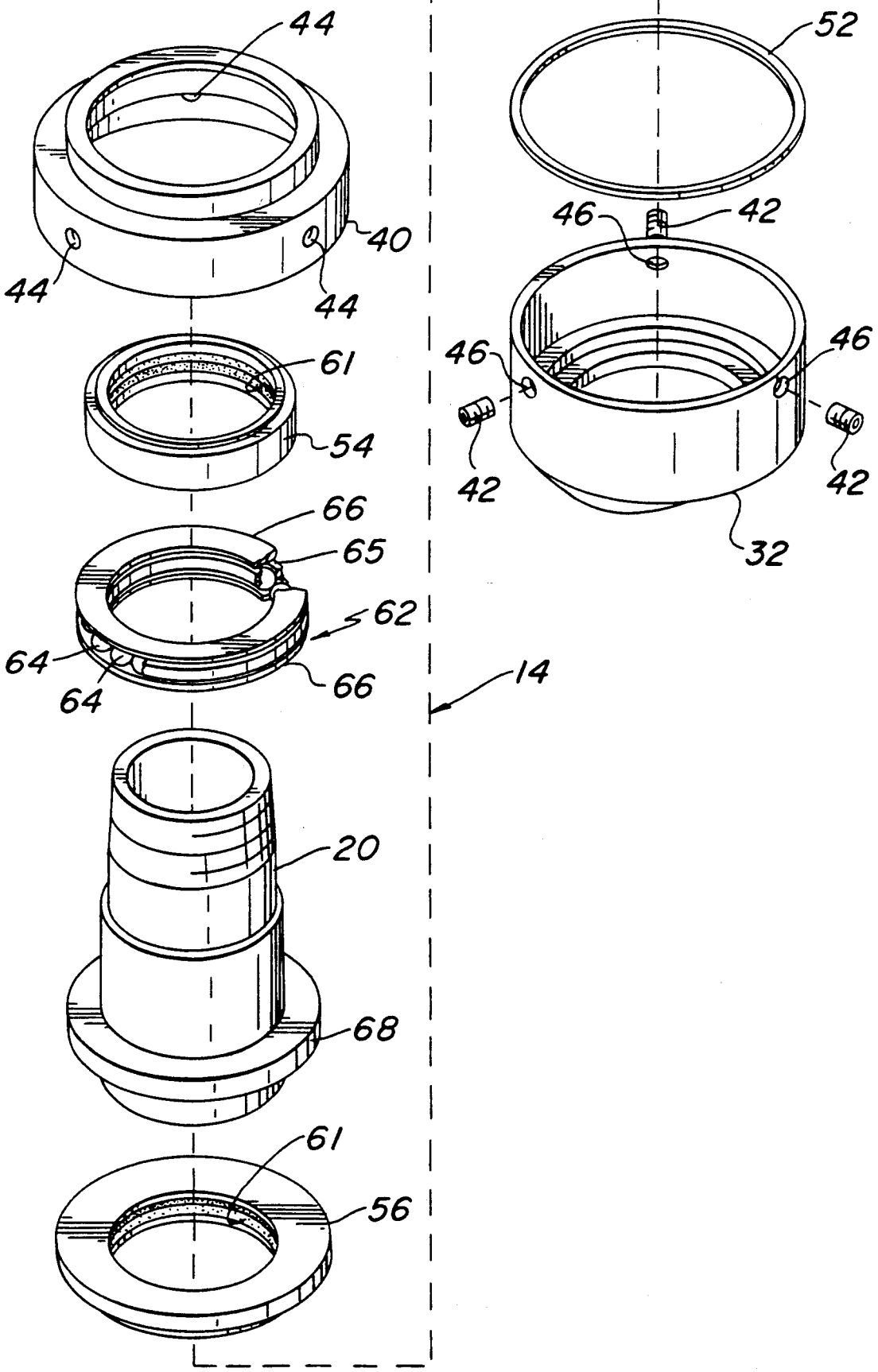
FIG. 4 is an exploded isometric view of the unique bearing assembly employed in the rotary agitator of this invention, but with the retainer for the ball bearings omitted for purposes of clarity. It should be noted that the retainer for the ball bearings is shown in the sectional views of FIGS. 2 and 3.

Referring to FIGS. 2–4, the center bearing assembly 14 employs an external rotor assembly 30 rotatably secured to the internal, substantially cylindrical, hollow stator 20. The external rotor assembly includes a lower saddle member 32 surrounding an opening 34 extending through the peripheral wall 36 of the arm 12 substantially at the midpoint of said arm.

In accordance with a preferred feature of this invention the central bearing assembly 14 has an internal passage having an open area which is approximately the same or greater than the open area of the throat section provided by the opening 34 in the arm 12. In other words, there are no significant restrictions in the fluid passageway located upstream of the opening 34, which, if present, could provide an undesired pressure buildup upstream of the arm 12. The above desirable benefits are achieved in this invention because applicants do not rely upon the use of a separate, internally threaded cylindrical pipe section to couple the central bearing assembly 14 to the arm 12, and also because applicants do not employ, as the rotor of the bearing assembly, the hollow, internal cylindrical section conventionally employed as the rotor in central bearing assemblies of prior art rotary agitators.

As can be seen best in FIGS. 2 and 3, the internal lower region of the saddle 32, which surrounds the elongate orifice 34, is secured to the arm 12 by a weldment 35, with the lower surface 37 of the saddle engaging the peripheral wall 36 of the arm 12. It should be noted that passageway 38 through the lower end of the saddle 32, which is defined by the lower surface 37 of the saddle 32, is elongate in the axial direction of the arm 12 to effectively circumscribe the orifice 34, with the lower surface of the saddle 32 engaging the peripheral wall 36 of the arm 12. It also should be noted that the internal passage through the hollow cylindrical stator 20 is aligned with the opening 34, and that the lower surface 39 of the stator is spaced in an upstream direction from the peripheral wall 36 of the arm 12, to thereby avoid the creation of a throat region of restricted area.

Referring again to FIGS. 2–4, the rotor assembly 30 also includes a stator cap or retainer 40 secured to the saddle 32 by threaded members 42 which are secured within threaded openings 44 passing through the peripheral sidewall 48 of the stator cap 40 and into aligned holes 46 in the peripheral sidewall 50 of the saddle 32. An annular gasket 52, made of neoprene or other suitable gasketing material, provides a seal between the saddle 32 and the stator cap 40.

The rotor assembly 30 also includes upper and lower isolation bearings 54, 56, respectively, having annular cavities 58 and 60 for receiving Quad Rings 61 for sealing against the internal, central stator 20 of the bearing assembly 14. The Quad Rings are synthetic rubber O-rings sold by Minnesota Rubber, a Quadion company, located in Minneapolis, Minn. Specifically, Minnesota Rubber refers to the synthetic rubber of Quad Rings as Compound 366Y.

Each of the bearings 54,56 is made from a plastic material sold under the trademark Ertalyte by ERTA, Incorporated, located in Exton, Pa.

The construction of the external rotor assembly 30 is completed by a bearing/race assembly 62. This latter assembly includes a plurality of ball bearings 64 rotatably secured together by a retainer 65 in a conventional manner, and positioned between thrust washers 66. The entire bearing/race assembly 62 is retained between a flange 62 extending radially from, and constituting a part of the elongate, internal stator 20, and adjacent downwardly facing surfaces 70 and 72 of the upper isolation bearing 54 and stator cap 40, respectively.

In view of the above construction applicant is able to economically construct the rotary agitator with all of the significant metal components being formed of stainless steel. Specifically, in the preferred form of the agitator 10, the arm 12, the saddle 32, the stator cup 40, the internal stator 20, and the retainer 65 for the ball bearings 64 are all made from type 304 stainless steel. The thrust washers 66 of the bearing/race assembly 62 are all made from type 420 stainless steel. The ball bearings 64 are made from 440 C stainless steel.

In an exemplary embodiment of this invention the arm 12 is a $1\frac{1}{4}$ inch pipe having an outside diameter of approximately 1.66 inches, and a wall thickness of approximately 0.065 inches; resulting in a nominal inside diameter of approximately 1.53 inches. The stator 20 is a pipe having an outside diameter of approximately 1.9 inches and a nominal inside diameter of approximately 1-7/16 inches. The hole 34 cut into the periphery of the arm 12 is provided with a hole saw having a diameter of approximately $1\frac{3}{8}$ inches, which, due to vibrations during cutting, results in the formation of a hole 34 having a diameter of approximately 1-7/16 inches, or even slightly greater. Thus, in the exemplary (and preferred) embodiments of this invention, the inside diameter of the stator 20 does not provide a significant restriction of the throat provided by the opening 34 in the arm 12.

The rotary agitator 10 of this invention can be economically formed from such stainless steel components because it employs less components and less complex machining operations than are required to fabricate the prior art rotary agitators identified in this application. Moreover, due to the unique arrangement of directly securing the external rotor assembly 30 of the central bearing assembly 14 to the rotary arm 12, without the use of additional tubular coupling elements, applicants have been able to provide an enlarged, unrestricted throat through the central bearing assembly 14.

Without further elaboration, the foregoing will so fully illustrate my invention that others may, by applying current or future knowledge, adopt the same for use under various conditions of service.

What is claimed as the invention is:

1. A rotary agitator for use in filter systems, said agitator comprising a horizontal arm formed of a single, elongate, tubular section having a peripheral wall defining a hollow interior, an opening through the peripheral wall of the tubular section at substantially the midpoint thereof, said opening communicating with the hollow interior of said tubular section, and an external rotor section of a central bearing assembly secured directly to the hollow tubular section in a region overlying the opening through the peripheral wall of the tubular section, said external rotor )section having a passageway therethrough communicating with the opening through the peripheral wall of the tubular section, said central bearing assembly further including an elongate stator having an elongate passage therethrough, said stator being disposed interiorly of the external rotor section with the passage of said stator aligned with and in communication with the opening through the peripheral wall of the tubular section, and bearing means for rotatably mounting the external rotor section to the stator section.

2. The rotary agitator of claim 1 wherein the diameter of the opening through the peripheral wall of the hollow tubular member is substantially equal to or greater than the diameter of the passage through the stator, and the external rotor section of the central bearing assembly includes a lower saddle member secured directly to the hollow tubular section, with the passageway of the external rotor section extending through the saddle member, said passageway, in the region in which the saddle member is secured to the hollow tubular section, being elongate in the axial direction of the hollow tubular section and overlying the elongate opening through the peripheral wall of the tubular section.

3. The rotary agitator of claim 2 wherein said lower saddle member is bonded directly to the hollow tubular member.

4. The rotary agitator of claim 2 wherein said lower saddle member has a lower surface engaging the peripheral wall of the hollow tubular member, said saddle member being welded directly to the hollow tubular member in a region where the lower surface of the saddle member engages the peripheral wall of the hollow tubular member.

5. The rotary agitator of claim 2 wherein the lower saddle member of the external rotor section is connected to the hollow tubular member forming the arm of the agitator by a weldment disposed at the internal surface of the saddle member and surrounding the elongate opening through the peripheral wall of the tubular section.

* * * * *